United States Patent [19]

Brine, Jr.

[11] Patent Number: 4,657,260

[45] Date of Patent: Apr. 14, 1987

[54] LACROSSE STICK HEAD FRAME

[76] Inventor: William H. Brine, Jr., Gypsy Ln., Weston, Mass. 02193

[21] Appl. No.: 639,717

[22] Filed: Aug. 13, 1984

[51] Int. Cl.[4] ..... A63B 59/02

[52] U.S. Cl. ..... 273/326

[58] Field of Search ..... 273/326, 73 C

[56] References Cited

U.S. PATENT DOCUMENTS

| | | | |
|---|---|---|---|
| 2,282,195 | 5/1942 | Le Compte | 273/73 C |
| 3,507,495 | 4/1970 | Tucker et al. | 273/326 |
| 4,291,574 | 9/1981 | Frolow | 273/73 C X |
| 4,358,117 | 11/1982 | Deutsch | 273/326 |

FOREIGN PATENT DOCUMENTS

| | | | |
|---|---|---|---|
| 424742 | 2/1935 | United Kingdom | 273/326 |

*Primary Examiner*—William H. Grieb

*Attorney, Agent, or Firm*—Wolf, Greenfield & Sacks

[57] ABSTRACT

A lacrosse stick head frame has elongated side walls extending outwardly from each other at a throat portion to a transverse top wall. The side walls lie generally in a plane and have a greater front to back thickness than side to side thickness. Stiffening flanges with enlarged outer walls parallel to the frame are provided on the side walls for stiffening the frame in its plane to prevent unwanted bending and flecture of the frame. Holes in the flange reduce overall weight of the device while retaining the strengthening feature.

4 Claims, 12 Drawing Figures

LACROSSE STICK HEAD FRAME

BACKGROUND OF THE INVENTION

Many lacrosse stick head frames are known in the art. In recent years organic plastic materials having great stiffness and resilience have been used, as for example set forth in U.S. Pat. No. 3,507,495. Such lacrosse stick head frames are made of a large number of polymeric materials which provide lightness, toughness and desired playing properties to the frame in conventional lacrosse games.

The organic plastic frames are subject to regulation by the Rules Committee. Thus standardized sizes, weights and the like have become accepted in lacrosse, with some variations within the standardized specifications. Often, the weight of organic plastic lacrosse head frames is about 5½ ounces.

It is been found that the stiffness of the resilient frame materials is sufficient in a front to back direction because of the substantially wider dimension of the sidewalls front to back, as opposed to the side to side dimension. However, the side to side stiffness has been found to be somewhat deficient in ordinary weight lacrosse stick heads. Bending of the head frames in the plane of the frame can affect play.

Because of the weight limitations, there is some difficulty in obtaining the required stiffness. Outer flanges in the plane of the head have been proposed before. Such flanges, while useful, provide some stiffness but overall weight is increased.

SUMMARY OF THE INVENTION

It is an object of this invention to provide an improved lacrosse stick head frame of any substantially conventional size and shape, but having improved stiffness and resistance to bending and distortion in the plane of the frame.

Another object of this invention is to provide an improved lacrosse stick head frame in accordance with the preceding object which can be manufactured rapidly and efficiently by substantially conventional techniques.

Another object of this invention is to provide a method of stiffening a lacrosse stick head frame in accordance with the preceding objects.

According to the invention, a lacrosse stick head frame comprises two elongated side walls extending preferably outwardly from each other at a throat portion to a transverse top wall. The side walls lie generally in a plane and are formed of a resilient organic plastic material having a predetermined stiffness. Means extend from the throat portion towards the transverse top wall outwardly of the side walls for stiffening the side walls in the plane of the frame. The means comprise a flange defining holes therein which reduce the overall weight added by use of the flange. The flange preferably has an outer enlarged wall which is preferably parallel to the side wall for providing stiffness to the side walls. Preferably the flange extends at least 25% of the distance from the throat portion to the transverse top wall.

It is a feature of this invention that the flange and outer enlarged wall provide an I-beam effect to the side wall encompassing the side wall. This gives great stiffness as may be desired in the plane of the frame preventing bending in use of the frame as when players coolide or when the stick hits the ground. The use of holes in the flange reduce the weight of the flange while leaving sufficient material to provide the desired stiffness. Surprisingly, the overall weight of the frame can be maintained at low values consistent with the feel of ordinary frames long used in the art. The stiffening means can be formed in conventional injection molding operations with or without later drilling as may be desired to form the holes. In some cases the holes are formed during molding procedures.

DESCRIPTION OF THE PREFERRED EMBODIMENTS

Figure 1:
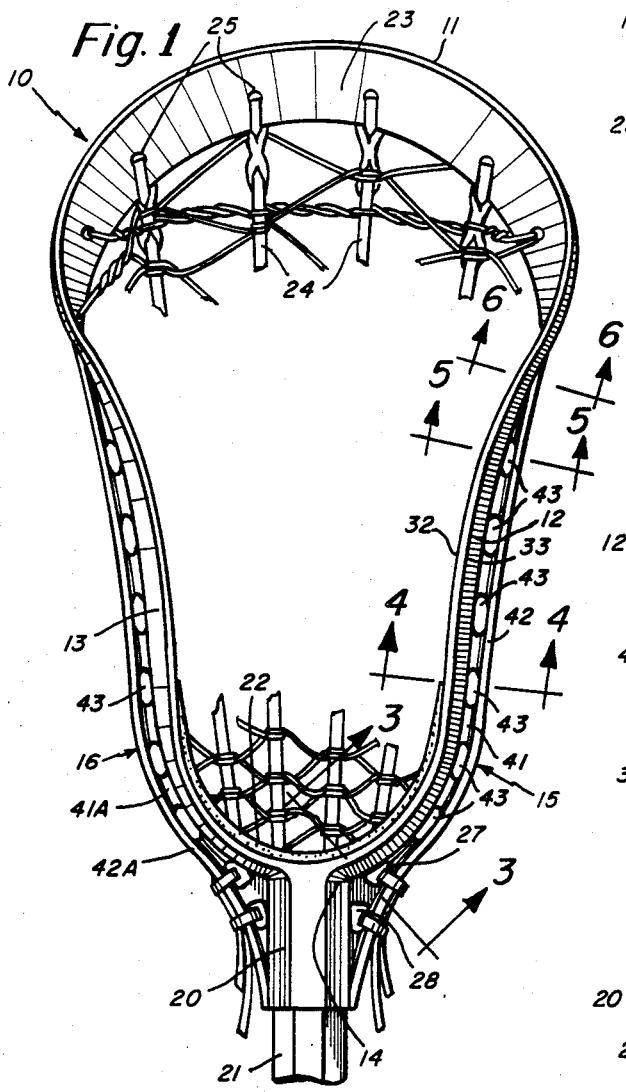
FIG. 1 is a top plan view of a preferred embodiment of a lacrosse stick head frame in accordance with this invention.
Figure 2:
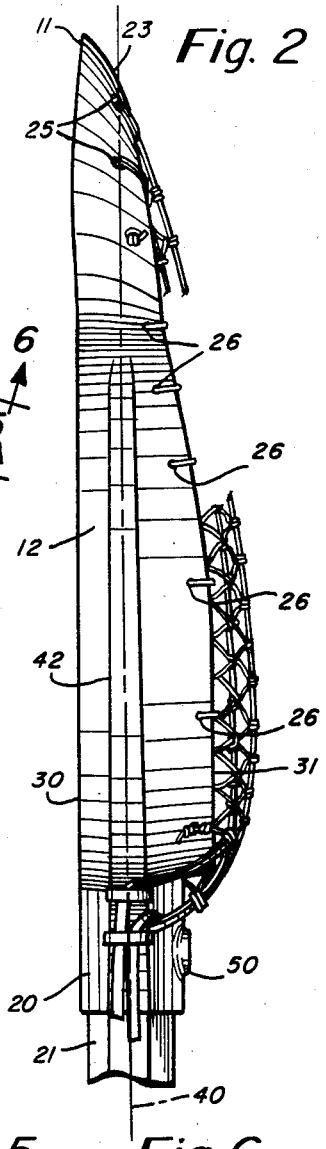
FIG. 2 is a right side view thereof.
Figure 3:
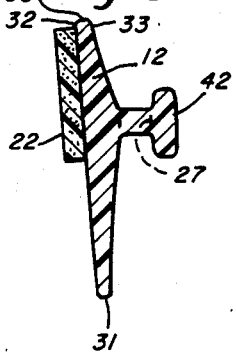
FIG. 3 is a cross-sectional view thereof taken through line 3—3 of FIG. 1.
Figure 4:
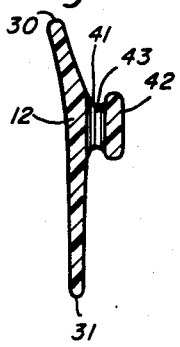
FIG. 4 is a cross-sectional view taken through line 4—4 of FIG. 1.

With reference now to the drawings and more particularly FIGS. 1 and 2, a lacrosse stick head frame 10 is illustrated having a top transverse wall 11, side walls 12 and 13, with a throat portion 14 of conventional construction except for the flange means 15 and 16 which extend outwardly from each of the side walls 12 and 13 respectively.

While the specific head frame of FIG. 1 will be fully described, it should be understood that the improvement of this invention is equally applicable to other head frame designs for lacrosse sticks, as for example the goalie head frame of FIG. 7-12, as will be described.

With reference now to the head frame 10 of FIG. 1, the material of the frame is preferably a conventional plastic known for use in lacrosse stick frames. Such materials are known in the art and can be of various types. Urethane elastomers, nylons, polyvinyl chloride materials and various polyester materials are known and useful, as for example the type described in U.S. Pat. No. 3,507,495. The organic plastic polymeric material of the frame is preferably stiff, yet has resiliency allowing it to be bent in use rather than cracking in use as is known.

The frame generally comprises a throat portion 14 having a receiving female end 20 for receiving a conventional stick handle 21. A ball stop 22 of foam rubber or the like is preferably mounted at the inside of the throat portion. The top transverse portion 11 is preferably angular as shown at 23 so as to have a scoop function. Conventional lacing or netting 24 is provided. Ordinarily the lacing is mounted in top portion holes 25 and side holes 26 which extend in the side walls as is known. Two end holes 27 and 28 on each side of the stick portion can be used for lacing the lacing in the form of thongs 24 to form the netting of the lacrosse stick as is known in the art.

The side walls generally have a front edge 30 and a back edge 31 generally parallel to each other and tapering towards the top end of the frame. This gives an overall width to the side walls so that the front to back dimension is greater than the side to side dimension. Thus, the height or front to back dimension 30-31 in the preferred embodiment 10 is about two inches while the width of the wall is approximately one eighth to one quarter inches from 32-33. The wall is somewhat inwardly curved at its front and is best shown in FIG. 1 to provide a general J-shape for aiding in trapping balls. However, the shape can vary as known.

The means for stiffening the frame acts to prevent distortion and movement in the plane defined by the frame itself and noted in the drawings at FIG. 2 by the dotted line 40. Thus line 40 is considered the plane of the frame and while it is true that the frame does not lie in a single plane, it can be described as generally lying in a plane for purposes of the present invention.

Flange means 15 and 16 are substantially identical with one lying on either side of a center line of the frame and only flange 15 will be fully described. Flange 15 is integrally molded with the rest of the frame shown in FIG. 1 of the same plastic polymeric material. It comprises a flange wall 41 substantially in the plane 40 or parallel thereto between the edges 30 and 31 and having an outer enlarged wall 42 extending substantially parallel to the side wall 12. The flange 41 and wall 42 together with the side wall portion to which it is integrally joined form in effect an I-beam construction which greatly stiffens the wall and provides support and strength in the plane 40, or substantially in the plane of the head, to prevent the head from bending from side to side as shown in FIG. 1 of the drawing.

A plurality of holes 43 are provided along the length of the flange 41. The holes can be formed in an injection molding process for the head or can later be formed by machining, drilling or the like as known in the art. Thus, the holes provide cut-away portions to reduce the weight of the head so that the overall weight of the head is substantially within the bounds of conventional head weights, as for example 4 to 9 ounces and preferably about 5½ ounces for regular heads of FIGS. 1-6 and 8 to 16 ounces for goalie heads. The size of the flange 15 and 16 is such that its top to bottom dimension, as shown in FIG. 1, extends at least as far as 25% of the top to bottom length of the frame as shown in FIG. 1. In the preferred embodiment of FIG. 1, the flange extends substantially all the way up the side wall to the top transverse member as it does in FIGS. 7 and 8 although this is not required in all cases.

The dimensions of the flange 41 can vary greatly. It can be made thicker or thinner and wider or narrower, depending upon the strengthening effect. Similarly the thickness and width of the wall 42 can vary as may be required.

Note FIGS. 3, 4, 5, and 6 which show cross sections along the side wall 12. It should be noted that the flange portion 41 varies from a wider portion at the throat gradually diminishing in width toward top 23. Flange 41 blends into the wall 42 which joins the outer side at the outer periphery of the frame as best shown in FIGS. 1 and 2.

Holes 43 function only to reduce the weight of the flange member 41 and thus maintain overall head frame weight within required values. Note that a great deal of adjustment in weight is possible by increasing or decreasing the size of the holes. The holes and cut out areas can comprise from 10 to 90% of the surface of flange 41. This allows for a great deal of variation in side wall dimensions and the dimension of the I-beam type construction. The holes can be circular bores or have any desired shape such as trapazoids, triangles, and the like.

Figure 5:
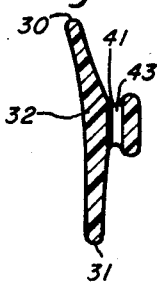
FIG. 5 is a cross-sectional view taken through line 5—5 of FIG. 1.
Figure 6:
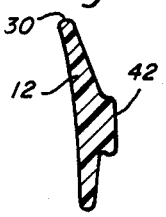
FIG. 6 is a cross-sectional view taken through line 6—6 of FIG. 1.

In a specific example of the preferred embodiment of FIG. 1, the overall throat to transverse top wall dimension is about 11 inches with the side to side dimension at the narrow portion of the frame at the level of FIG. 5 being about 5 inches and at the level above FIG. 6 at its widest portion being about 7 inches. The side walls have a front to back dimension 30-31 of about 2 inches and a side to side dimension 32-33 of about ⅛ inches. Flange 41 extends away from the outer side wall for a distance of about ¼ inches and has a thickness of about ⅛ inches. Wall 42 has a front to back dimension of about ½ inches and a thickness of about ⅛ inches. The frame is formed of a modified nylon such as Nylon 733 obtained from Custom Resin Inc. of Kentucky.

A frame formed as described, has greater stiffness against bending in the plane 40 than conventional lacrosse stick frames. It should be pointed out that prior art frames have been made with structures which compare to flanges such as 41. However, the use of the cut-out or hole portions along with the outer wall 42 which preferably forms an I-beam type construction is not known in this art and does provide an unobvious result. The fact that prevention of such bending provides significant advantages in a construction of this type has been found to be desirable in this very well-known and old sport.

Figure 7:
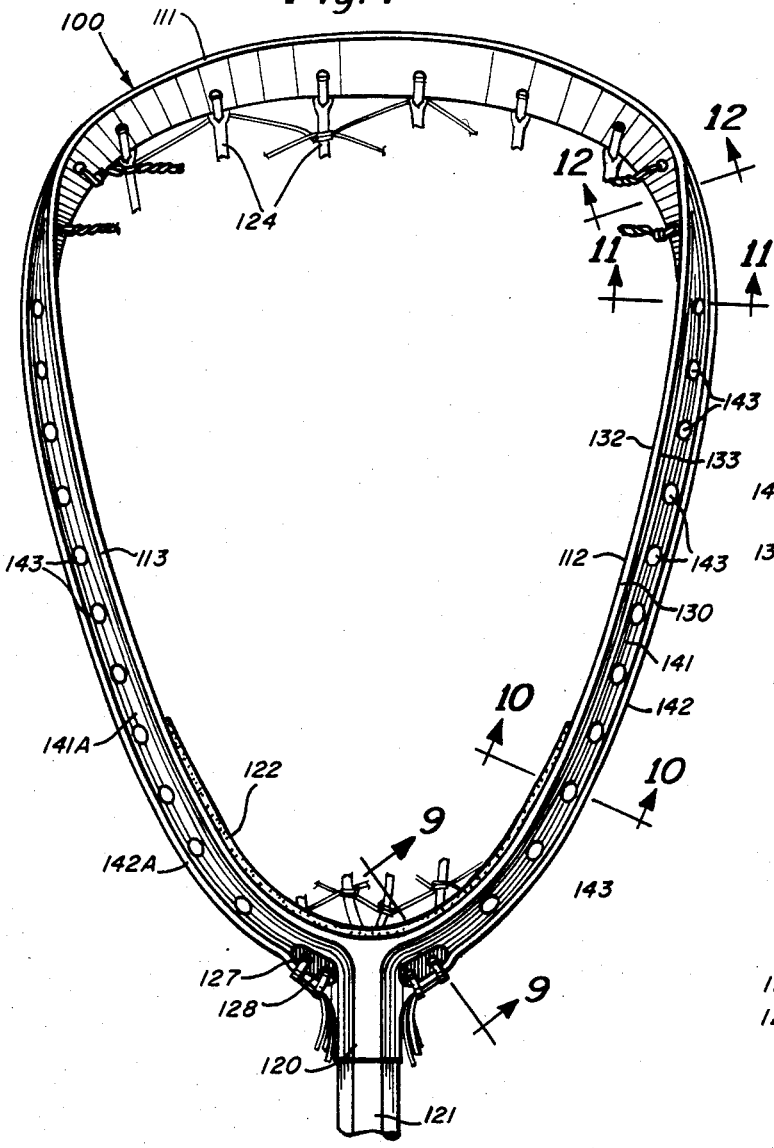
FIG. 7 is a top plan view of an alternate embodiment thereof.

Turning now to an alternate embodiment of this invention, a goalie head frame is shown at 100 in FIG. 7. The goalie head frame has a top transverse wall 111 with side walls 112 and 113. Flanges 141 and 141A are provided. Outer walls 142 and 142A form the I-beam construction as previously described along with flanges 141 and 141A and side walls 112 and 113 respectively as previously described. Holes 143 lessen the weight of the device. Tab mounting holes 127 and 128 can be used for mounting of the netting 124.

In each case with respect to this embodiment, where the portions are substantially as described above except for the design shape changes shown, the parts are marked with the same number as corresponding parts in FIG. 1 with 100 added to that number.

Figure 8:
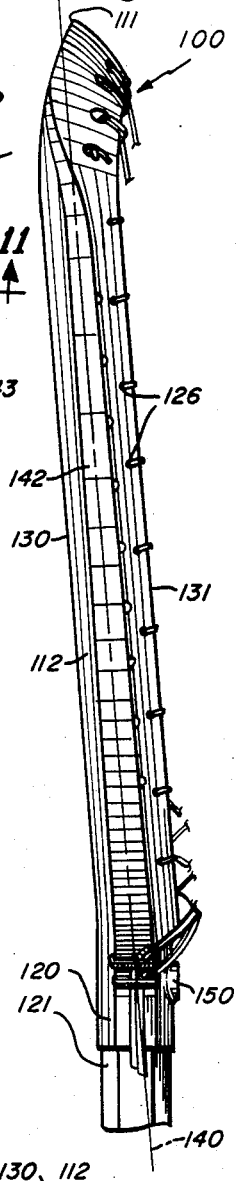
FIG. 8 is a right side view of the embodiment of FIG. 7.

FIG. 8 shows the frame 100 which is mounted at a slight angle to the stick 121 by means of a screw through the hole port 150 corresponding to the hole port 50 of the embodiment of FIG. 1. Although there is a slight angle, the plane of the frame shown at 140 can still be easily determined by one skilled in the art for purposes of description in this invention.

Figure 9:
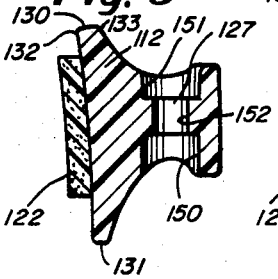
FIGS. 9-12 are respectively cross-sectional views through lines 9—9, 10—10, 11—11 and 12—12 of FIG. 7.
Figure 10:
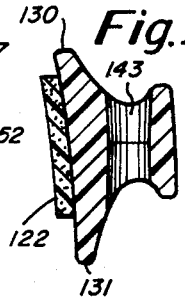
Figure 11:
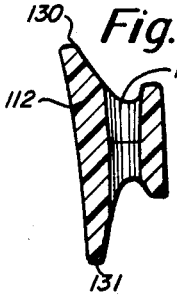
Figure 12:
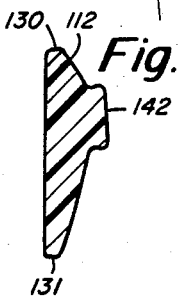

FIGS. 9-12 correspond generally to FIGS. 3-6 shown in connection with the embodiment of FIG. 1. The only difference is that in this embodiment, hole 127 as shown in FIG. 9 has a circular recess at 150 and 151 with the circular recesses joining a circular bore 152. Preferably, holes 27-28 and 127-128 are recessed as shown to aid in stringing of the netting 124. In some cases, these mounting holes need not be used and the stringing can be of any conventional form to form the net with the pocket required by the user.

While specific embodiments of this invention have been shown and described, it should understood that many variations are possible. In all cases, the object is to provide stiffness to prevent side to side bending of the frame and to rigidify the side walls in order to accomplish this purpose without substantially increasing the weight of the racket to undesirable levels. A proper balance of holes, flange dimensions and outer wall dimensions act to provide the requirements necessary here. Such dimensions can be varied to meet the desires of users within the requirements of the rules for head frame size and weight.

What is claimed is:

1. A lacrosse stick head frame comprising:

elongated side walls extending outwarding from each other at a throat portion ot a transverse top wall, said side walls lying generally in a plane and formed of a resilient organic plastic material, having a predetermined stiffness, means extending from said throat portion towards said transverse top wall for stiffening said side walls in said plane, said means comprising a flange extending outwardly from the side walls and having holes therein for obtaining desired stiffness in said frame at a desired weight, said flange having an outer enlarged wall enlarged in a direction substantially perpendicular to said flange providing stiffness to said side walls.

2. A method of providing side to side increased rigidity in a lacrosse stick head frame comprising:

providing said frame with a substantially planar flange extending substantially outwardly from said side wall in the plane of said frame or parallel thereto and having an end wall at an outer portion thereof enlarged in a direction substantially perpendicular to said plane of said frame to define an I-beam construction with said side wall, said flange having cut-out portiosn to crease overall weight of said frame.

3. A method in accordance with claim 2 wherein said lacross stick head frame is formed by injection molding.

4. In a lacrosse stick head frame having elongated sidewalls extending upwardly from each other at a throat portion to a transverse top wall, with the sidewalls lying generally in a plane and formed of a resiliently organic plastic material having a predetermined stiffness, the improvement comprising, means extending from the throat portion toward the transverse top wall along the outside of each sidewall for stiffening said sidewalls in said plane with said means comprising an outwardly extending flange having holes therein for obtaining desired stiffness in said frame at a desired frame weight, said flange extending at least 25% of the distance along each sidewall from said throat to said top wall, and an outer wall to said flange and enlarged in a direction substantially perpendicular to said plane in which said sidewalls are lying, wherein each of said sidewall portions act as an I-beam to provide increased rigidity against bending in said plane.

* * * * *